US011352864B2

(12) United States Patent
Brown et al.

(10) Patent No.: US 11,352,864 B2
(45) Date of Patent: Jun. 7, 2022

(54) ESP STRING PROTECTION APPARATUS

(71) Applicant: Halliburton Energy Services, Inc., Houston, TX (US)

(72) Inventors: Donn J. Brown, Broken Arrow, OK (US); David C. Beck, Broken Arrow, OK (US); Trevor A. Kopecky, Owasso, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 107 days.

(21) Appl. No.: 16/410,715

(22) Filed: May 13, 2019

(65) Prior Publication Data

US 2020/0362684 A1 Nov. 19, 2020

(51) Int. Cl.

| | |
|---|---|
| ***E21B 43/12*** | (2006.01) |
| ***E21B 43/38*** | (2006.01) |
| *E21B 33/12* | (2006.01) |

(52) U.S. Cl.

CPC ..... *E21B 43/128* (2013.01); *E21B 43/38* (2013.01); *E21B 33/12* (2013.01)

(58) Field of Classification Search

CPC ..... E21B 43/38; E21B 43/128

See application file for complete search history.

(56) References Cited

U.S. PATENT DOCUMENTS

| | | | | |
|---|---|---|---|---|
| 6,089,322 | A * | 7/2000 | Kelley | E21B 43/38 166/370 |
| 6,173,768 | B1 | 1/2001 | Watson | |
| 6,932,160 | B2 | 8/2005 | Murray et al. | |
| 7,766,081 | B2 | 8/2010 | Brown et al. | |
| 9,670,758 | B2 | 6/2017 | Wilson et al. | |
| 2015/0053394 | A1 | 2/2015 | Reid et al. | |
| 2016/0222773 | A1 | 8/2016 | Sims et al. | |

FOREIGN PATENT DOCUMENTS

| | | |
|---|---|---|
| RU | 2464413 C1 | 10/2012 |

OTHER PUBLICATIONS

International Search Report and Written Opinion dated Jul. 17, 2020; International PCT Application No. PCT/US2020/026216.

* cited by examiner

*Primary Examiner* — Robert E Fuller
(74) *Attorney, Agent, or Firm* — McGuireWoods LLP

(57) ABSTRACT

A system for protecting an Electrical Submersible Pump (ESP) string from gas slugs in a downhole well environment. The system comprises an intake tube having a first and second end and one of a packer having a bypass channel and an inverted shroud coupled to the intake tube and the ESP string. The intake tube is independent of a pump and a motor of the ESP string. The system can comprise a bypass tube for channeling the gas slug downstream of the pump. The bypass tube is integrated with the packer. The inverted shroud is coupled with the first end of the intake tube and a section of production tubing downstream from the pump and the motor. The inverted shroud forms a bypass path channel within a casing annulus.

9 Claims, 3 Drawing Sheets

ESP STRING PROTECTION APPARATUS

BACKGROUND

In unconventional wells with horizontal lateral sections, undulations in the lateral sections can cause pockets of gas to accumulate at high points before exiting in the form of an elongated bubble called a gas slug. These slugs flow into a vertical section of a wellbore where an ESP (Electrical Submersible Pump) is located and, in some cases, expand to completely fill the wellbore as they move toward the surface. ESPs are designed to move liquids and perform poorly when attempting to move gases. While small quantities of gas are detrimental to the performance of ESPs, large quantities of gas, as found in a gas slug, can create a "gas lock" condition, which blocks liquid flow through an ESP. When in a gas lock condition, the ESP is partially filled with gas and catastrophic damage can rapidly occur due to the lack of liquid lubrication on the pump's internal bearing surfaces. In essence, these pockets of gas can increase the costs of production and slow down production.

BRIEF DESCRIPTION OF THE DRAWINGS

For a more complete understanding of the features and advantages of the present disclosure, reference is now made to the detailed description along with the accompanying figures in which corresponding numerals in the different figures refer to corresponding parts and in which.

DETAILED DESCRIPTION

Figure 1:
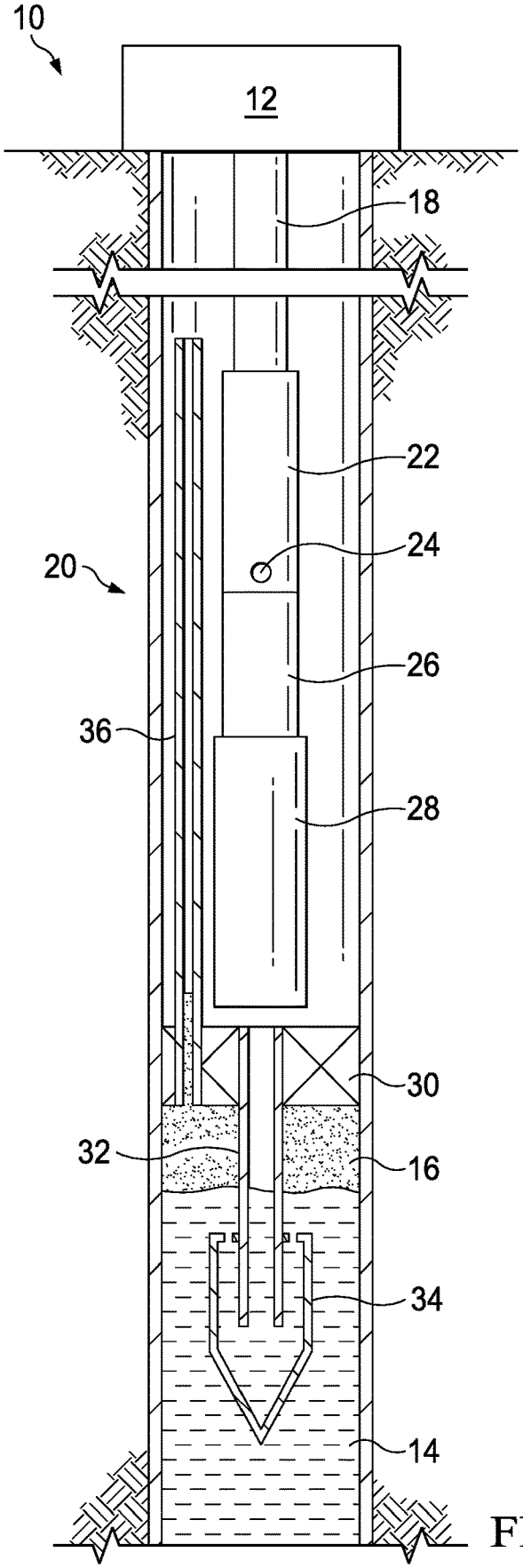
FIG. 1 is an illustration of a system configuration for pumping fluid from hydrocarbon reservoirs, in accordance with certain example embodiments.

While the making and using of various embodiments of the present disclosure are discussed in detail below, it should be appreciated that the present disclosure provides many applicable inventive concepts, which can be embodied in a wide variety of specific contexts. The specific embodiments discussed herein are merely illustrative and do not delimit the scope of the present disclosure. In the interest of clarity, not all features of an actual implementation may be described in the present disclosure. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would be a routine undertaking for those of ordinary skill in the art having the benefit of this disclosure.

There are a number of gas separation devices on the market that bypass the entrance ports of a pump using reverse flow, in which the gas and liquid phases flow past the pump intake through a bypass area and, at the top of the bypass area, the liquid separates by means of gravity and flows back down to the intake. These devices can successfully function at low flow rates; however, at high flow rates the turbulence and velocity increases cause the gas to be drawn downwards with the liquid into the pump intake. As such, a large pocket of gas mixed in with high flow rate liquid can damage the pump.

This present disclosure discloses innovative solutions that address large quantities of gas in dispersed bubble flow and or slug flow by creating a gas escape or bypass around intake ports of an ESP pump, thereby greatly reducing the amount of gas ingested by the pump. A packer assembly is presented that can be configured to protect intake ports of a pump in a ESP string by sealing or blocking an area within well casing of a wellbore just below the pump by means of a packer and bypass channel or a packer and inverted shroud.

In a first configuration, the packer is configured to interface with an intake tube and a bypass tube and create a seal with the intake tube, the bypass channel, and the well casing. In a production environment, the intake tube can extend a distance below the packer that communicates through the packer to an area of the well casing just below the motor. The intake tube takes advantage of the differences in the inertia and buoyancy of the liquid and gas in the area of lower velocity below the ESP. The gas, due to its buoyancy and lesser inertia, flows past the intake tube and flows up to the packer where it then flows through an escape or bypass tube, i.e. an area installed through the packer, which extends above the pump's intake. The liquid either enters the intake tube below the packer and/or flows into the top of the shroud after flowing through the escape or bypass area and is thus separated from much of the gas. In another configuration, an inverted shroud is used to seal off intake ports of an ESP pump and create a flow path around the intake ports. In traditional practice, shrouds are configured to extend from just below the pump intake ports, at the seal head, and extend above the pump. This is to allow the liquid and gas going between the motor and the well bore to cool the motor. While at the same time, the fluid, i.e. liquid and gas, has to travel to the top of the shroud and back down between the shroud ID and the pumps OD (Outer Diameter) to enter the pump's intake. In this other configuration, the inverted shroud extends to below the motor and liquid entering from the intake tube travels past the motor for the cooling affect. In yet another configuration, the aforementioned configurations can be used along with positioning an intake port in a deviated section of the casing to take advantage of natural separation of gas and liquid, i.e., into a section of the well bore where the orientation changes from vertical to a more horizontal orientation. In these deviated sections, gravitational and buoyant forces act in opposition on the liquid and gas causing natural separation of the phases with the gas accumulating on the upper part of the well bore and the liquid accumulating in the lower part of the well bore.

Large amounts of gas, often called gas slugs, are considered one of the foremost challenges in artificial lift, particularly in high flow wells (over 3000 BPD). The design configurations presented herein can eliminate problems caused by gas slugs. As a result, total production can be increased since damage to an ESP can be reduced and, therefore, ESP uptime can be increased. This can result in improved gas handling products and service quality, which can translate into increased revenue and decreased cost.

In this specification, the terms downstream and upstream refer to in the direction of a wellhead or the surface, or a location closer thereto, and in the direction of a reservoir, or a location closer thereto, respectively. A packer is a component of the completion hardware of oil or gas wells used to provide a seal between the outside of production tubing and inside of a wellbore casing.

Referring now to FIG. 1, illustrated is a diagram of a system configuration for pumping fluid from hydrocarbon reservoirs, in accordance with certain example embodiments, denoted generally as 10. The system 10 comprises an ESP controller 12 for causing an ESP string to pull liquid 14 from a hydrocarbon reservoir that prevents a gas pocket 16, or gas slug, from damaging a pump of the ESP string. The system 10 further comprises production tubing 18 within a well casing 20 and the ESP string comprises a pump 22 having an intake port 24, a seal 26, and a motor 28. The system 10 also includes a packer 30, an intake tube 32, an inverted shroud 34 coupled to the intake tube 32, and a bypass tube 36. The packer 30 includes multiple sleeves for receiving the intake tube 32 and the bypass tube 36 or otherwise the packer 30 includes sectioned out channels that can couple with the tubes. The packer 30 can create a seal around the tubes and a seal with the well casing 20, in effect providing a protection barrier for the ESP string.

The intake tube 32 communicates through the packer to the ESP string and extends downward through a gas pocket that has accumulated below the packer 30. The inverted shroud 34 provides a reverse flow component at the entrance of the intake tube 32 that reduces the amount of gas that enters. The intake tube 32 and the inverted shroud 34 are positioned below the ESP string and the diameter of the intake tube 32 is diametrically much smaller than the ESP string. This reduced diameter naturally reduces the velocity of the fluids entering the intake tube 32 and inverted shroud 34 which enhances the opposing forces of two phase fluids: buoyancy of the gas and gravitational force of the liquid. The inverted shroud 34, situated in this area, lessens the velocity of the fluid, which allows separation methods based on directed flow to take advantage of the greater buoyancy of the gas and reduces the quantity of gas carried by the liquid. In this fashion, the liquid naturally flows downward into the intake tube 32 towards the lower pressure area created by the pump 22 while the more buoyant gas flows upward through the bypass tube.

Figure 2:
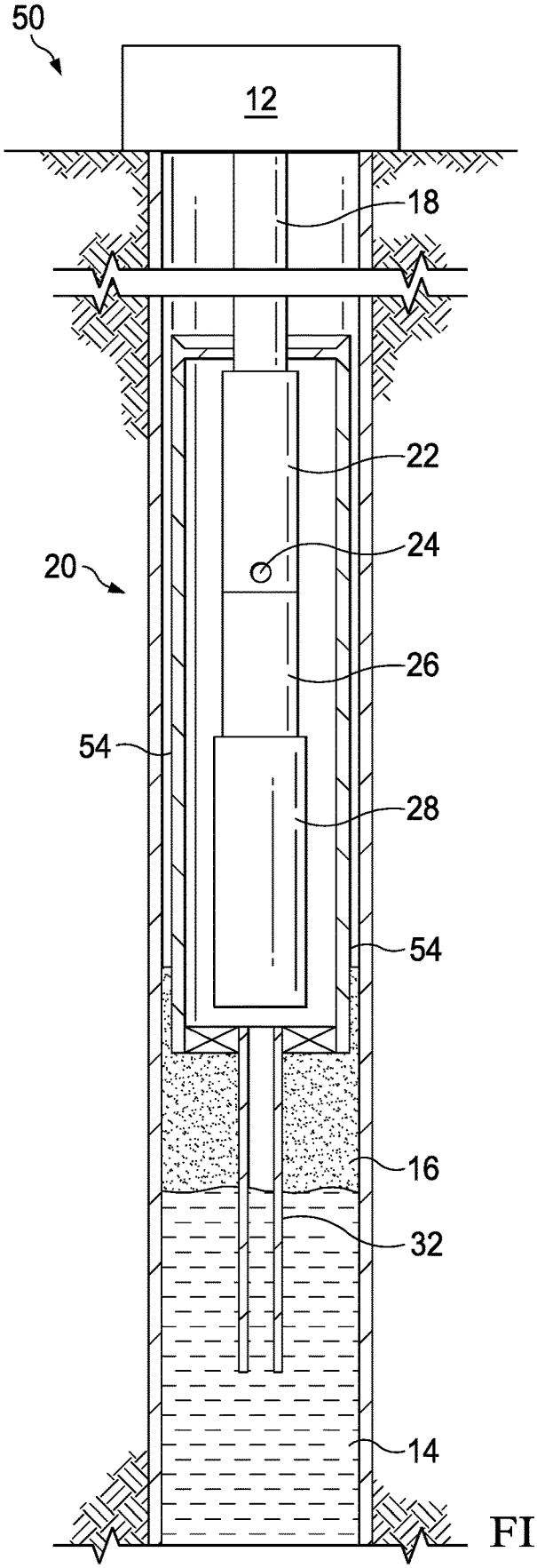
FIG. 2 is an illustration of another system configuration for pumping fluid from hydrocarbon reservoirs, in accordance with certain example embodiments.

Referring now to FIG. 2, illustrated is a diagram of another system configuration for pumping fluid from hydrocarbon reservoirs, in accordance with certain example embodiments, denoted generally as 50. The system 50 comprises production tubing 18, the motor 28, seal 26, pump 22, intake tube 32, and inverted shroud 54. In this configuration, the ESP string is enclosed within the inverted shroud 54. The inverted shroud 54 is coupled to the intake tube 32 and the production tubing 18. Although, obviously, other coupling arrangements can be realized. The area within the annulus of the casing around the shroud 54 serves as a bypass around the pump's intake port 24. The intake tube 32 communicates through the bottom of the inverted shroud 54 and allows liquid to enter the bottom of the shroud below the motor and flow to the pump's intake port 24. An advantage of this configuration is that it can be assembled at the well site and lowered into the well casing as one unit.

Figure 3:
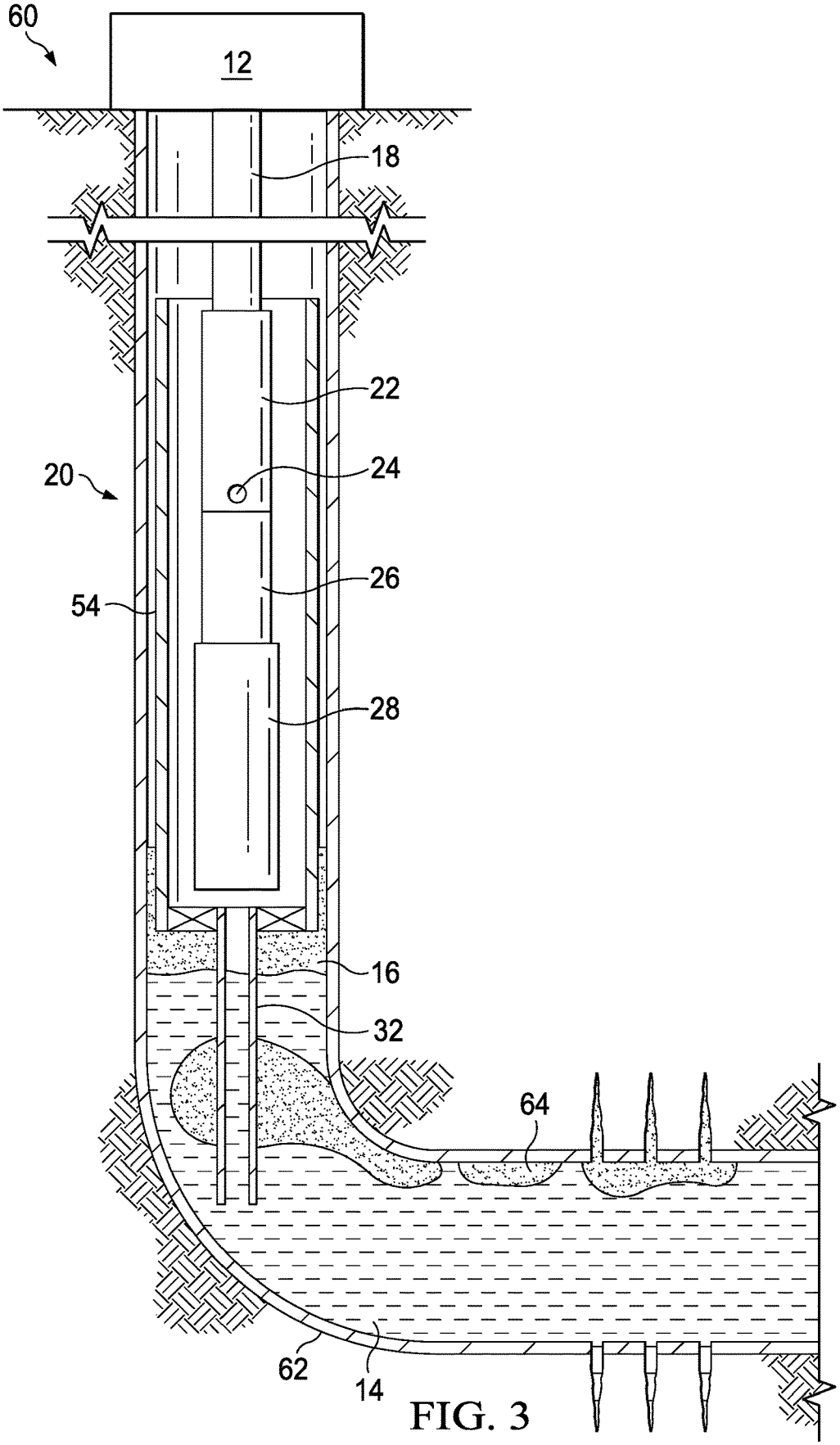
FIG. 3 is an illustration of a system configuration strategically positioned within a well casing of a wellbore to pump fluid from hydrocarbon reservoirs, in accordance with certain example embodiments.

Referring now to FIG. 3, illustrated is a diagram of system configuration 50 strategically positioned within the well casing 20 to pump fluid from hydrocarbon reservoirs, in certain example embodiments, denoted generally as 60. As illustrated, the intake tube 32 is positioned within the well casing 20 in away that takes advantage of a deviated section 62 within the well casing 20. The entrance of the intake tube 32 is positioned in the lower portion of the deviated section 62 where liquid accumulates under natural separation. If positioned correctly, gas pockets 64 can be prevented from entering the intake tube and, thus, preventing damage to the pump 22. Although system configuration 50 is illustrated it is also contemplated the use of system configuration 10 in the strategic positioning of the intake tube 32.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. The scope of the claims is intended to broadly cover the disclosed embodiments and any such modification. Further, the following clauses represent additional embodiments of the disclosure and should be considered within the scope of the disclosure:

Clause 1, a system for protecting an Electrical Submersible Pump (ESP) string having a pump and a motor, the system comprising: an intake tube having a first and second end; and one of a packer and an inverted shroud coupled to the intake tube and having a bypass channel; wherein the intake tube is independent of the pump and the motor;

Clause 2, the system of clause 1 further comprising a bypass tube for channeling the gas pocket downstream of the pump and motor;

Clause 3, the system of clause 2 wherein the bypass tube is coupled with the packer;

Clause 4, the system of clause 2 wherein the packer assembly comprises a sleeve forming a channel for receiving the bypass tube;

Clause 5, the system of clause 2 wherein the packer assembly and the bypass tube are positioned upstream from the ESP string and independent of the ESP string;

Clause 6, the system of clause 1 wherein the inverted shroud is coupled with the first end of the intake tube;

Clause 7, the system of clause 6 wherein the inverted shroud is coupled with a section of production tubing downstream from the pump and the motor;

Clause 8, the system of clause 6 wherein the inverted shroud forms a bypass path within a casing annulus;

Clause 9, the system of clause 1 wherein another inverted shroud is coupled to the second end of the intake tube;

Clause 10, an apparatus for protecting an Electrical Submersible Pump (ESP) system having a pump and a motor, the apparatus comprising: an intake port having a first and second end; and a bypass channel extending above the pump; wherein the intake port is independent of the pump and the motor;

Clause 11, the apparatus of clause 10 further comprising a packer coupled to the first end of the intake port;

Clause 12, the apparatus of clause 11 wherein the bypass channel is a bypass tube coupled to the packer;

Clause 13, the apparatus of clause 11 wherein the packer comprises a sleeve forming a channel for receiving the bypass tube;

Clause 14, the apparatus of clause 10 further comprising an inverted shroud for shielding the pump and the motor from the gas pocket;

Clause 15, the apparatus of clause 14 wherein the inverted shroud is coupled with a section of production tubing above the pump and the motor;

Clause 16, the apparatus of clause 15 wherein the inverted shroud is coupled with the first end of the intake tube;

Clause 17, the apparatus of clause 10 further comprising an inverted shroud coupled with the second end of the intake port;

Clause 18, a method of operating an ESP system having a pump and a motor, the method comprising: pumping fluid from a downhole reservoir through a gas bypass assembly using the pump and the motor; wherein the gas bypass assembly comprises: an intake port having a first and second end; and a bypass channel extending above the pump; wherein the intake port is independent of the pump and the motor;

Clause 19, the method of clause 18 wherein the gas bypass assembly further comprises a packer coupled to the first end of the intake port and a bypass tube coupled to the packer; and Clause 20, the method of claim 18 wherein the gas bypass assembly further comprises: an inverted shroud for shielding the pump and the motor from the gas pocket; wherein the inverted shroud is coupled with a section of production tubing above the pump and the motor; wherein the inverted shroud is coupled with the first end of the intake tube; wherein the packer comprises a sleeve forming a channel for receiving the bypass tube.

What is claimed is:

1. A system comprising:

an Electrical Submersible Pump (ESP) string having a pump and a motor, the pump having at least one intake port;

an intake tube having a first and second end;

a barrier device coupled to the first end of the intake tube, the barrier device having a bypass channel formed therein and a bypass tube extending therefrom, the second end of the intake tube extending below the barrier device;

the barrier device, the intake tube, and the bypass channel physically separate of the ESP string;

the barrier device configured to create a seal with a section of well casing below the ESP string and the bypass tube;

the barrier device and the intake tube configured to communicate a first fluid to the pump; and the barrier device and the bypass tube configured to communicate a second fluid to a section in a wellbore above the at least one intake port.

2. The system of claim 1 wherein the barrier device is a packer.

3. The system of claim 2 wherein the packer comprises a sleeve that is configured to receive the bypass tube.

4. The system of claim 1 wherein an inverted shroud is coupled to the second end of the intake tube.

5. The system of claim 4 wherein the intake tube and the inverted shroud are configured to reduce the velocity of the first fluid.

6. An apparatus for protecting an Electrical Submersible Pump (ESP) string having a pump and a motor, the pump having at least one intake port, the apparatus comprising:

an intake tube having a first and second end;

a barrier device coupled to the first end of the intake tube, the barrier device having a bypass channel formed therein and a bypass tube extending therefrom, the second end of the intake tube extending below the barrier device;

the barrier device, the intake tube, and the bypass channel physically separate of the ESP string;

the barrier device configured to create a seal with a section of well casing below the ESP string and the bypass tube;

the barrier device and the intake tube configured to communicate a first fluid to the pump; and the barrier device and the bypass tube configured to communicate a second fluid to a section in a wellbore above the at least one intake port.

7. The apparatus of claim 6 wherein the barrier device is a packer.

8. The apparatus of claim 7 wherein the packer comprises a sleeve that is configured to receive the bypass tube.

9. The apparatus of claim 6 further comprising an inverted shroud coupled with the second end of the intake tube.

* * * * *